US009849948B2

(12) United States Patent
Skipworth

(10) Patent No.: US 9,849,948 B2
(45) Date of Patent: Dec. 26, 2017

(54) PERSONAL FLOTATION ASSEMBLY WITH PROTECTIVE SHELL

(71) Applicant: Bryan Skipworth, Vicksburg, MS (US)

(72) Inventor: Bryan Skipworth, Vicksburg, MS (US)

( * ) Notice: Subject to any disclaimer, the term of this patent is extended or adjusted under 35 U.S.C. 154(b) by 0 days.

(21) Appl. No.: 15/089,732

(22) Filed: Apr. 4, 2016

(65) Prior Publication Data

US 2016/0304177 A1 Oct. 20, 2016

Related U.S. Application Data

(60) Provisional application No. 62/147,074, filed on Apr. 14, 2015.

(51) Int. Cl.

| | |
|---|---|
| ***B63C 9/08*** | (2006.01) |
| ***B63C 9/20*** | (2006.01) |
| ***B63C 9/05*** | (2006.01) |

(52) U.S. Cl.

CPC ..... *B63C 9/08* (2013.01); *B63C 9/05* (2013.01); *B63C 9/20* (2013.01)

(58) Field of Classification Search

CPC .... B63C 9/00; B63C 9/05; B63C 9/06; B63C 9/08; B63C 9/16; B63C 9/20

USPC ..... 441/86, 87, 89, 103

See application file for complete search history.

(56) References Cited

U.S. PATENT DOCUMENTS

| | | | | |
|---|---|---|---|---|
| 676,836 | A * | 6/1901 | Brown | B63C 9/02 441/86 |
| 1,078,640 | A * | 11/1913 | Pinczes | B63C 9/06 441/87 |
| 3,222,701 | A * | 12/1965 | Fest | B63C 9/082 441/86 |
| 3,428,978 | A * | 2/1969 | Johnson | B63C 9/02 441/86 |
| 3,986,220 | A * | 10/1976 | Johnson | B63C 9/05 441/86 |
| 4,652,246 | A | 3/1987 | Thorgeirsson | |
| 5,158,489 | A | 10/1992 | Araki | |
| 2010/0248567 | A1 | 9/2010 | Carl | |
| 2012/0270453 | A1 | 10/2012 | Chang | |

* cited by examiner

*Primary Examiner* — Lars A Olson
(74) *Attorney, Agent, or Firm* — Global Intellectual Property Agency, LLC; Daniel Enea

(57) ABSTRACT

A personal flotation assembly is provided that includes flotation device and a protective shell extending therefrom. The flotation device is a buoyant structure that includes an open interior, such as a ring or similar shape. Along the lower end of the flotation device is a protective shell. The shell includes a spiral expansion spring therein and a resilient construction, whereby the shell is adapted to compress against the flotation device when stored and expand outward when deployed. When deployed, the shell forms a rounded sidewall, an enclosed lower, and an interior volume sized to receive the floating user. The shell is made of a resilient material and is water permeable. Therefore, the flotation assembly supports a floating user and protects the user when adrift for long periods. Additional locating elements may be secured to the floatation device, including strobes or signal generators.

20 Claims, 4 Drawing Sheets

PERSONAL FLOTATION ASSEMBLY WITH PROTECTIVE SHELL

CROSS REFERENCE TO RELATED APPLICATION

This application claims the benefit of U.S. Provisional Application No. 62/147,074 filed on Apr. 14, 2015, entitled. The above identified patent application is herein incorporated by reference in its entirety to provide continuity of disclosure.

BACKGROUND OF THE INVENTION

Field of the Invention

The present invention relates to flotation devices and life preservers. More specifically, the present invention relates to a flotation device that provides an occupant shell that protects that occupant from the open water when adrift for long periods of time.

Emergency flotation devices save lives. These devices assist flotation of a user when in open water, and are commonly found on boats, planes, and other vessels that cross bodies of water. If forced to abandon the vessel, such flotation devices can help a user float for long periods and prevent drowning. Common flotation devices include ring buoys, life jackets, and other personal flotation devices. A user can rely on the buoyancy of the flotation device, reducing effort required to tread water or remain afloat.

However, most flotation devices are suited for emergency situations and are not ideal for long-term, open water use. In the event a user must abandon a vessel and enter the open water, a small inflatable craft or boat is more desirable. However, this is not always available. As a consequence, the user relies on the personal flotation device and is otherwise exposed to the open water. Over time, the user can encounter sea life, including carnivorous fish, jelly fish, and sharks. Therefore, a need exists for an improved emergency floatation device that protects the user floating in the water over long periods.

The present invention provides a personal flotation device that is sized for personal use and suited for long-term use in open waters. In particular, the present invention provides a ring-shaped flotation device with an open interior that assists a user floating in water. Along the lower end of the flotation device is a biased shell assembly that extends outward when deployed. The shell extends downward and provides an enclosed interior volume that supports the floating user. The shell is resilient and protective of the user. Furthermore, the shell is permeable, whereby the interior of the shell is filled with water. Therefore, the user can float within the ring and the shell for long periods, whereby the shell separates the user from the open water to prevent biting or stinging from open water threats.

SUMMARY OF THE INVENTION

The following summary is intended solely for the benefit of the reader and is not intended to be limiting in any way. The present invention provides a new personal flotation assembly that can be utilized for assisting a user float in open water and protecting the user while in use.

It is therefore an object of the present invention to provide a new and improved personal flotation assembly that has all of the advantages of the prior art and none of the disadvantages.

It is another object of the present invention to provide a personal flotation assembly that provides a buoyant flotation device that floats on the surface of the water, and a protective shell that extends downward from the flotation device that shrouds the user's body in the water.

Another object of the present invention is to provide a personal flotation assembly that comprises a flotation device having an annular body that surrounds a user in the water, and an open interior that is sized to receive the user within the interior of the flotation device.

Another object of the present invention is to provide a personal flotation assembly whereby the flotation device comprising a buoyant structure that is adapted to receive the user therethrough.

Another object of the present invention is to provide a personal flotation assembly that comprises a protective shell secured to a lower portion of the flotation device. The protective shell has a perimeter sidewall and a lower surface forming an open interior. Furthermore, the protective shell has an open upper disposed below the open interior of the flotation device. The protective shell is adapted to receive the user within its interior volume and shroud the user from the open water while allowing water to penetrate therethrough such that the user floats within the shell interior.

Another object of the present invention is to provide a personal flotation assembly whereby the protective shell is collapsible against the flotation device and expandable therefrom.

Another object of the present invention is to provide a personal flotation assembly whereby a spiral expansion spring is disposed within the sidewall of the protective shell. The spiral expansion spring has a coiled structure, an extended length, and an open interior. In the compressed state, the spiral expansion spring is compressed towards the lower portion of the flotation device. In the extended state, the spiral expansion spring is extends downward from the lower portion of the flotation device, whereby the extended length of the compressed state is less than the extended length of the extended state. When extended, the spring expands the sidewalls of the protective shell for a user to enter the interior thereof.

Another object of the present invention is to provide a personal flotation assembly whereby the sidewall of the protective shell is a flexible structure and the spiral expansion spring is disposed therein. The flexible structure of the sidewall therefore expands and contracts with the spiral expansion spring.

Another object of the present invention is to provide a personal flotation assembly whereby the open interior of the flotation device being sized to receive a user therein. Moreover, the extended length of the protective shell may be sized when in the extended state to receive a user therein at least up to the chest of the user.

Another object of the present invention is to provide a personal flotation assembly whereby the spiral expansion spring further comprises a fiberglass coil spring affixed to the sidewall of the protective shell.

Another object of the present invention is to provide a personal flotation assembly whereby the spiral expansion spring further comprises a metal coil spring affixed to the sidewall of the protective shell.

Another object of the present invention is to provide a personal flotation assembly whereby the spiral expansion spring is disposed within a sheath that extends around and is affixed to the sidewall of the protective shell.

Another object of the present invention is to provide a personal flotation assembly whereby the sidewall and lower surface of the protective shell are water permeable.

Another object of the present invention is to provide a personal flotation assembly whereby the sidewall and lower surface of the protective shell are comprised of a resilient material that is resistant to puncture and tearing. In one embodiment, the material further comprises a Kevlar layer.

Another object of the present invention is to provide a personal flotation assembly whereby the sidewall and lower surface of the protective shell may further comprise one or more mesh layers that are water permeable.

Another object of the present invention is to provide a personal flotation assembly whereby the flotation device further comprises an annular body or ring buoy.

Another object of the present invention is to provide a personal flotation assembly whereby the protective shell further comprises a cylindrical shape.

Another object of the present invention is to provide a personal flotation assembly whereby the flotation device further comprises strobe light.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
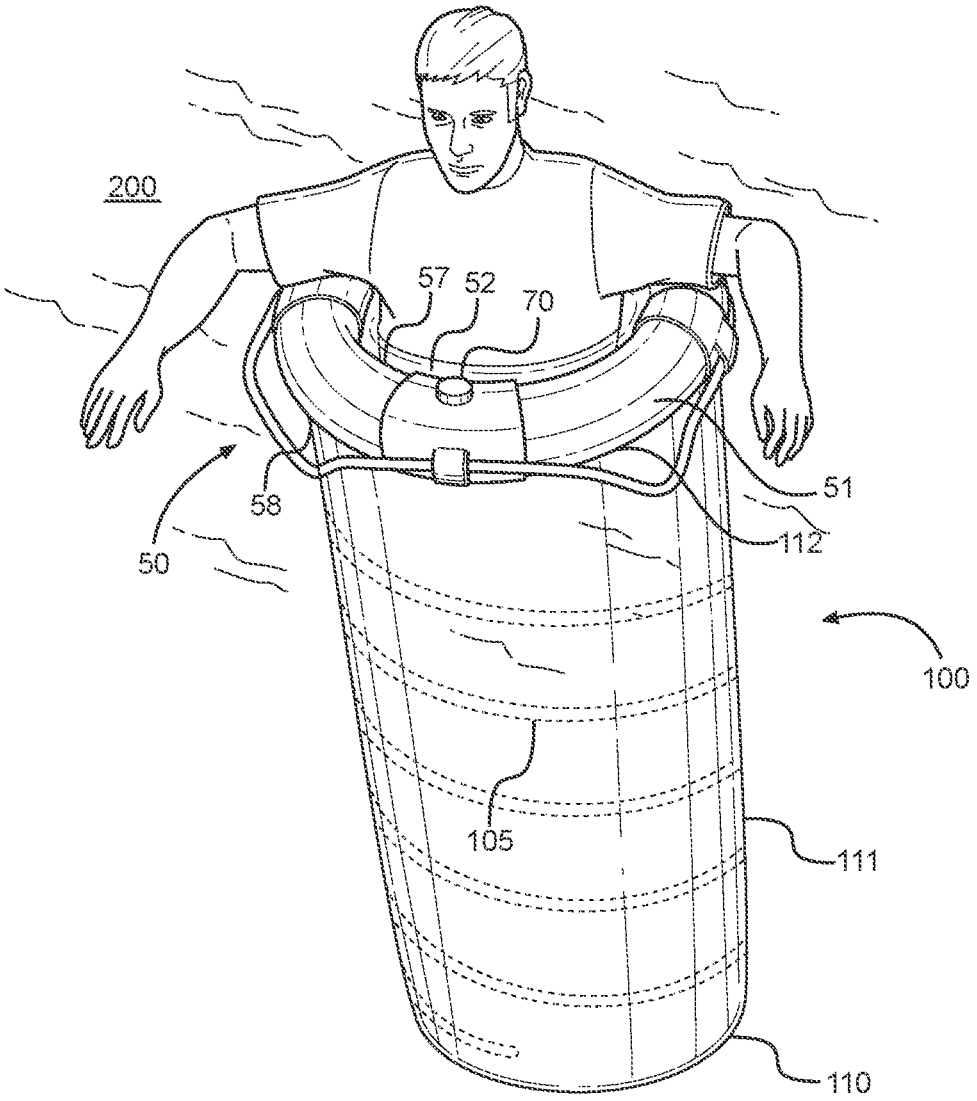
FIG. 1 shows a view of the personal flotation assembly of the present invention in a working state.

Reference is made herein to the attached drawings. Like reference numerals are used throughout the drawings to depict like or similar elements of the personal flotation assembly of the present invention. For the purposes of presenting a brief and clear description of the present invention, the preferred embodiment will be discussed as used for providing a personal flotation device to a user while protecting the user from the open water by shrouding his or her body in the water with a protective shell. The figures are intended for representative purposes only and should not be considered to be limiting in any respect.

Figure 3:
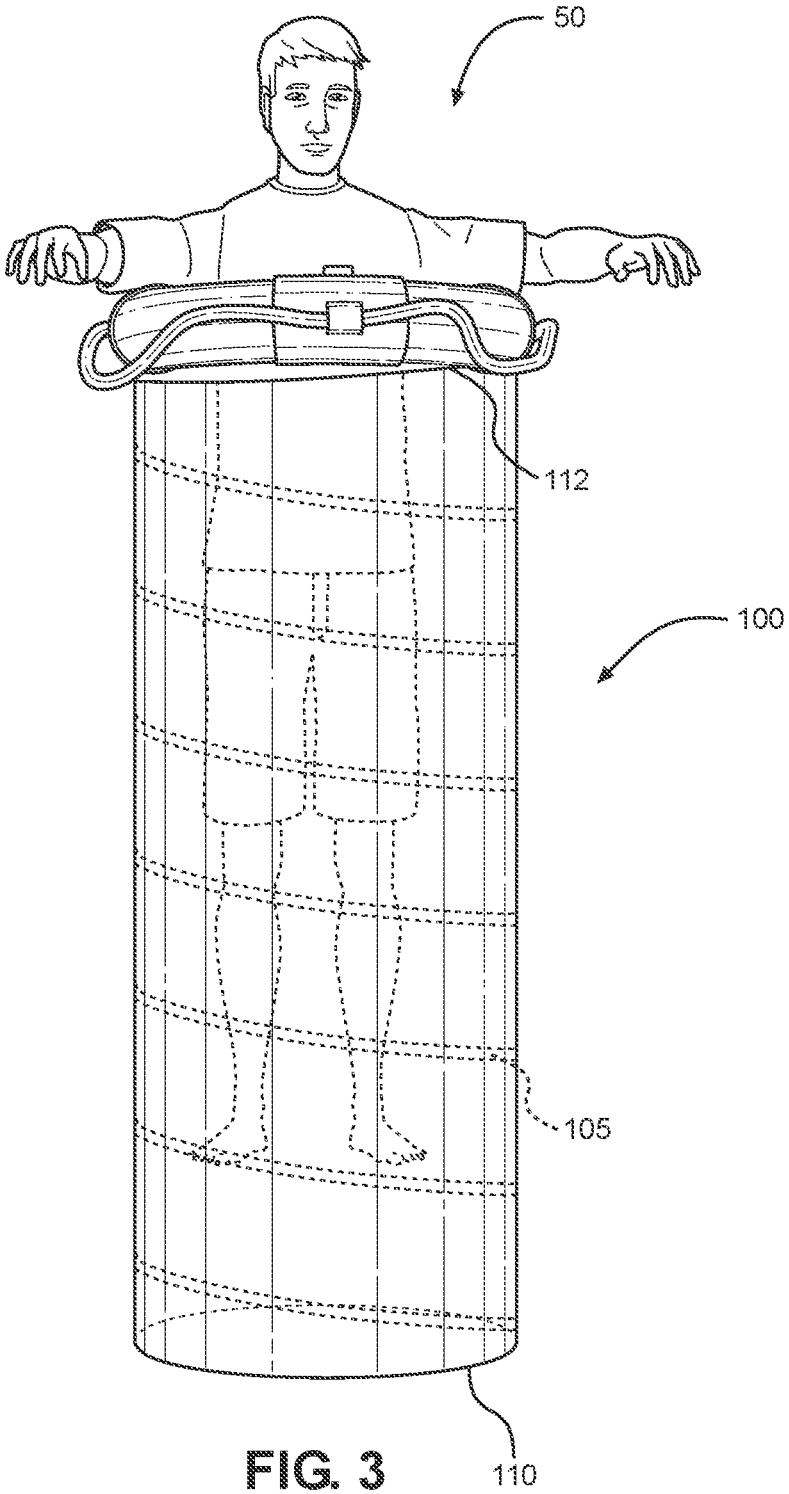
FIG. 3 shows another view of the personal flotation assembly in a working state.

Referring now to FIGS. 1 and 3, there are shown views of the personal flotation assembly of the present invention in a working state. The assembly comprises a flotation device 50 and a protective shell 100 extending therefrom. The assembly is adapted to be utilized in emergency situations or in situations when the user is in the water 200 and requires flotation assistance. The flotation device 50 is a buoyant structure with an opening interior 52 that is sized to receive a user therein. The size of the flotation device 50 may be specific to individual users or have different sizes, but is designed for supporting a human user within the interior 52 thereof.

The flotation device 50 may comprise different shapes and be have different materials that give the device 50 its buoyant properties. In one embodiment, the flotation device is an annular ring 57 that is adapted to surround a user within its open interior 52. The annular ring 57 may be similar to a ring buoy, or alternatively have a rounded interior shape and an outer sidewall 51 that extends outward in different shapes (i.e. a large square shape with a rounded hole, etc.). In any embodiment, the user floats within the interior 52 of the flotation device 50 and can rest his or her arms over the top of the device 50 to remain afloat for long periods.

Extending below the flotation device is a protective shell 100. The protective shell 100 is secured to a lower portion 58 of the flotation device 50 and extends downward therefrom. The protective shell 100 comprises an open upper 112 disposed below the open interior 52 of the flotation device 50, whereby the shell 50 forms an enclosure that surrounds the floating user supported by the flotation device 50. In particular, the protective shell 100 has a perimeter sidewall 111 and a lower surface 110 forming an enclosed interior with an open upper. The open upper is disposed below the open interior 52 of the flotation device 50 such that a user when entering the flotation device interior 52, enters into the interior of the protective shell 100.

The protective shell 100 is one that expands when the assembly is deployed, and collapses against the flotation device 50 when the assembly is stowed. To expand the shell 100, a spiral expansion spring 105 is disposed within the sidewall 111 thereof that biases the shell 100 into an expanded state. The spiral expansion spring 105 has a coiled structure that extends along or through the sidewall 111 of the shell 100 and expands the shell 100 into its expanded state when the assembly is deployed. The spring 105 has an extended length and an open interior. The open interior is coextensive with the open interior of the shell 100, such that the diameter of the spring 105 is equal to the diameter of the shell 100 and the spring 105 is disposed against or within the sidewall 111.

To allow the spiral expansion spring 105 to expand the shell 100, the sidewall 111 of the protective shell 100 comprising a flexible structure. The spring 105 furthermore has a compressed state and an extended state. When in the compressed state, the spiral expansion spring 105 is compressed towards the lower portion 58 of the flotation device 50 and the flexible sidewall 111 is condensed thereagainst. When the spring 105 is in an extended state, the spiral expansion spring 105 extends downward from the lower portion 58 of the flotation device 50 such that the sidewalls 111 are expanded and the shell 100 provides an open interior sized to receive a floating user therein. Thus, the extended length of the spring 105 in its compressed state is substantially less than the extended length of the spring 105 in its extended state.

Figure 2:
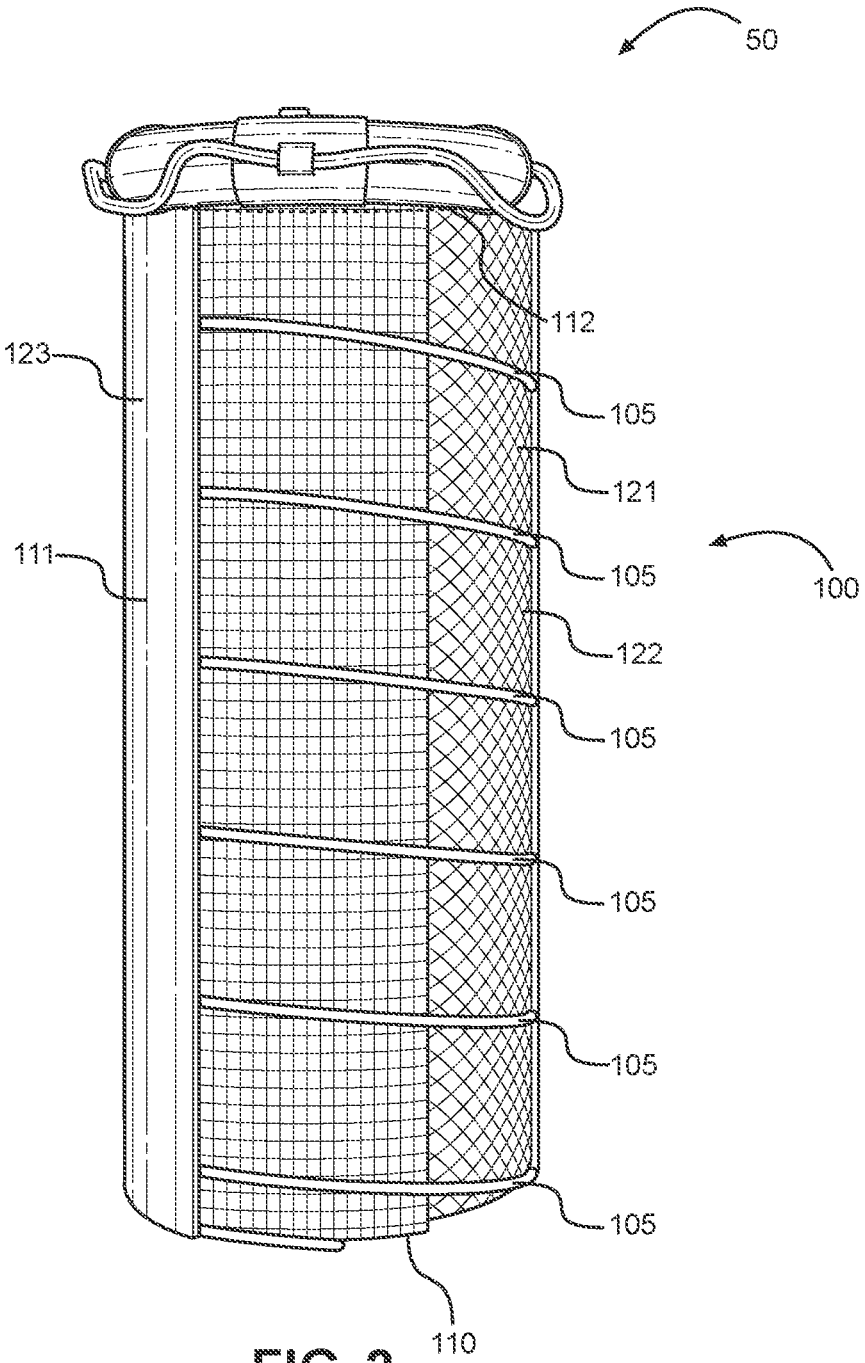
FIG. 2 shows a cut-away view of one embodiment of the personal flotation assembly of the present invention.

Referring to FIG. 2, there is shown a cut-away view of the flotation assembly of the present invention in a deployed state. The assembly comprises a flotation device 50 and a protective shell 100 that extends therefrom. The shell 100 has an upper end 112 that is connected to the lower portion of the flotation device 50. The expansion spring 105 is one that spirals around the rounded sidewall 111 of the shell and extends from the upper end 112 to the lower end 110 thereof. In one embodiment, the spiral spring 105 is disposed within the sidewall 111. In other embodiments, the spring 105 is disposed along the outer surface or interior surface of the shell sidewall 111. In any embodiment, the spring 105 is preferably connected to the sidewall 111 along its length such that the spring 105 expands the flexible sidewall 11 of the shell when the spring expands to its deployed state.

The spiral expansion spring 105 itself may comprise different materials or constructions. In one embodiment, the spiral expansion spring 105 comprises a fiberglass coil spring affixed to the sidewall 111 of the protective shell 105 along the length of the spring 105. In another embodiment, the spiral expansion spring 105 comprises a metal coil spring affixed to the sidewall 111 of the protective shell 100 along its length. In other embodiments, the spring 105 and sidewall 111 may be disconnected and the spring 105 may be disposed within the interior of the shell 100, whereby eth spring acts on the base 110 of the shell 100 to expand the shell to its deployed state. In yet another embodiment, the spiral expansion spring 105 is disposed within a sheath that extends around and is affixed to the sidewall 111 of the protective shell 100.

The protective shell 100 is a water permeable structure that is puncture and tear resistant. The shell 100 may comprise a singular layer of material, or may comprise a composite of several layers forming its structure. Preferably, the shell 100 is flexible such that the shell can be condensed against the flotation device 50 and expands therefrom by way of the expansion spring 105. In one embodiment, the shell sidewall 111 comprises a cylindrical shape and has several layers. Each of the layers is water permeable or has sufficient openings therethrough to allow water to infiltrate the interior of the shell such that the user floats within the interior of the shell while in use. This is so the shell 100 remains below the buoyant flotation device 50 and is not prone to flipping over. If the interior of the shell is submerged and filled with water, the shell 100 will remain below water and below the buoyant flotation device 50.

One embodiment of the multilayer shell comprises one or more layers of para-aramid synthetic fibers 121, commonly known as Kevlar. The Kevlar layers are resistant to puncture and tearing, and may form portions of the sidewall. The Kevlar layer or layers 121 may further include openings or holes to allow water to flow therethrough, while an outer protective layer 123 protects the Kevlar from water. Alternative or additional layers may comprise resilient mesh layers 122, such as braided steel mesh or the like. The intent of the shell 100 is to provide a water permeable structure that surrounds the user, while also offering protecting against punch and tearing in the event of a shark attack or contact with other sea life. In this manner, the user is protected from below and from the sides, and can float within the interior of the shell 100 while resting his or her head above water on the flotation device.

The extended length of the shell 100 when deployed is preferably sized to receive a human therein up to the user's chest. This may be several feet in length. It is not desired to claim a specific length or height for the shell, but to describe a shell of several feet in height such that a user can float within the interior of the shell while resting his or her shoulders and arms on the flotation device 50 (see FIGS. 1 and 3). Moreover, the shell 100 preferably has a cylindrical shape. The shape may differ from the preferred shape, however, and may include alternative cross sectional shapes as desired by the user and the manufacturer.

Figure 4:
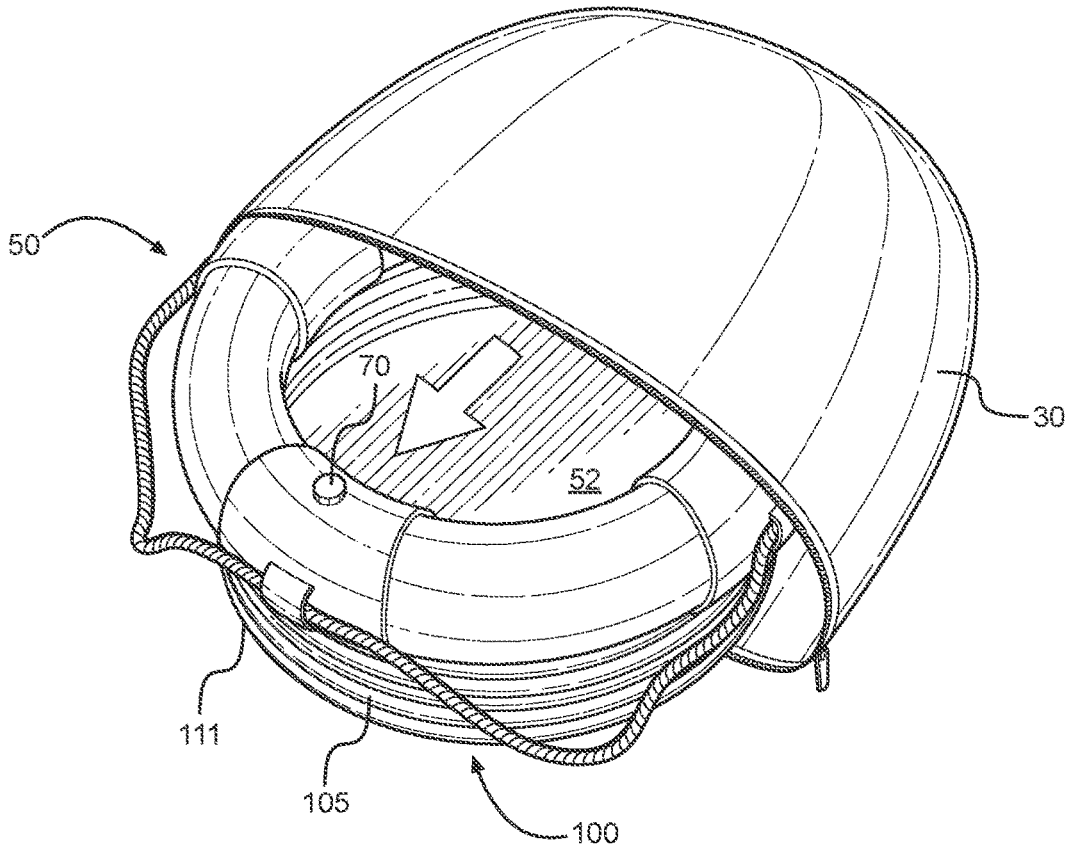
FIG. 4 shows a view of the personal flotation assembly in a collapsed state, whereby the protective shell is compressed against the flotation device.

Referring now to FIG. 4, there is shown a view of the flotation assembly of the present invention in a collapsed state. The protective shell 100 is collapsed against the flotation device 50 such that the extended length of the spring 105 is minimized. This reduces the height of the assembly such that it can be stored in a carry pouch 30 or secured in a condensed state with a strap therearound. In this state, the sidewall 111 of the shell is collapsed against the flotation device 50 such that the lower end of the shell abuts against the open interior 52 of the flotation device 50. This allows the assembly to be stored in a collapsed state until use is required.

In addition to providing a buoyant and protective structure, the assembly may further include locating devices. The locating devices provide a signal to find a user adrift in the ocean. These may include a strobe light 70, an electronic location device, or similar electronic assembly that assists to visualize the user or locate the user using radio signals.

Overall, the floatation assembly is designed to assist a floating a user in a body of water, whereby the user is supported in a generally upright position. The assembly more specifically comprises a floatation device forming a floatation ring with a central opening through which the user can be positioned. The shell extends from the lower end thereof. The floatation device preferably comprises a water buoyant, rigid foamed material such as foamed polystyrene; however, alternative materials and constructions of the flotation device are contemplated.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective personal flotation assembly, comprising:

a flotation device having an open interior;

the flotation device comprising a buoyant structure;

a protective shell secured to a lower portion of the flotation device;

the protective shell having a perimeter sidewall and a lower surface forming an open interior;

the protective shell further having an open upper disposed below the open interior of the flotation device;

a spiral expansion spring disposed within the sidewall of the protective shell;

the spiral expansion spring having a coiled structure, an extended length, and an open interior;

the sidewall of the protective shell comprising a flexible structure and the spiral expansion spring having a compressed state and an extended state;

whereby in the compressed state, the spiral expansion spring is compressed towards the lower portion of the flotation device;

whereby in the extended state, the spiral expansion spring extends downward from the lower portion of the flotation device;

the extended length of the compressed state being less than the extended length of the extended state;

wherein the spiral expansion spring is disposed within a sheath that extends around and is affixed to the sidewall of the protective shell.

2. The protective flotation assembly of claim 1, wherein the open interior of the flotation device is sized to receive a user therein.

3. The protective flotation assembly of claim 1, wherein the extended length of the protective shell when in the extended state is adapted to receive a user therein at least up to a chest of the user.

4. The protective flotation assembly of claim 1, wherein the spiral expansion spring further comprises a fiberglass coil spring affixed to the sidewall of the protective shell.

5. The protective flotation assembly of claim 1, wherein the spiral expansion spring further comprises a metal coil spring affixed to the sidewall of the protective shell.

6. The protective flotation assembly of claim 1, wherein the sidewall and lower surface of the protective shell are water permeable.

7. The protective flotation assembly of claim 1, wherein the sidewall and lower surface of the protective shell further comprise one or more layers of para-aramid synthetic fibers.

8. The protective flotation assembly of claim 1, wherein the sidewall and lower surface of the protective shell further comprise a puncture and tear resistant material.

9. The protective flotation assembly of claim 1, wherein the flotation device further comprises a ring buoy.

10. The protective flotation assembly of claim 1, wherein the flotation device further comprises an annular body.

11. The protective flotation assembly of claim 1, wherein the protective shell further comprises a cylindrical shape.

12. The protective flotation assembly of claim 1, wherein the flotation device further comprises strobe light.

13. A protective personal flotation assembly, comprising:

a flotation device having an open interior;

the flotation device comprising a buoyant structure;

a protective shell secured to a lower portion of the flotation device;

the protective shell having a perimeter sidewall and a lower surface forming an open interior;

the protective shell further having an open upper disposed below the open interior of the flotation device;

a spiral expansion spring disposed within the sidewall of the protective shell;

the spiral expansion spring having a coiled structure, an extended length, and an open interior;

the sidewall of the protective shell comprising a flexible structure and the spiral expansion spring having a compressed state and an extended state;

whereby in the compressed state, the spiral expansion spring is compressed towards the lower portion of the flotation device;

whereby in the extended state, the spiral expansion spring extends downward from the lower portion of the flotation device;

the extended length of the compressed state being less than the extended length of the extended state;

wherein the sidewall and lower surface of the protective shell further comprise a mesh construction that is water permeable.

14. The protective flotation assembly of claim 13, wherein the open interior of the flotation device is sized to receive a user therein.

15. The protective flotation assembly of claim 13, wherein the extended length of the protective shell when in the extended state is adapted to receive a user therein at least up to a chest of the user.

16. The protective flotation assembly of claim 13, wherein the spiral expansion spring further comprises a fiberglass coil spring affixed to the sidewall of the protective shell.

17. The protective flotation assembly of claim 13, wherein the spiral expansion spring further comprises a metal coil spring affixed to the sidewall of the protective shell.

18. The protective flotation assembly of claim 13, wherein the sidewall and lower surface of the protective shell are water permeable.

19. The protective flotation assembly of claim 13, wherein the flotation device further comprises a ring buoy.

20. The protective flotation assembly of claim 13, wherein the sidewall and lower surface of the protective shell further comprise a puncture and tear resistant material.

* * * * *